US005536074A

United States Patent [19]

Hsu et al.

[11] Patent Number: 5,536,074

[45] Date of Patent: Jul. 16, 1996

[54] LIGHT-GENERATING WHEEL FOR AN IN-LINE SKATE

[76] Inventors: Chi-Hsueh Hsu; Chih-Yes Shyu; Jong-Yes Shyu, all of 4F, No. 144, Chu-Lin Road, Yung-Ho Shih, Taipei Hsien, Taiwan

[21] Appl. No.: 309,977

[22] Filed: Sep. 20, 1994

[51] Int. Cl.[6] ..... A63C 17/26

[52] U.S. Cl. ..... 301/5.3; 362/78

[58] Field of Search ..... 301/5.3, 5.7, 64.7; 280/11.19, 11.22, 11.23; 362/35, 78

[56] References Cited

U.S. PATENT DOCUMENTS

| | | | |
|---|---|---|---|
| 2,871,061 | 1/1959 | Behm et al. | 301/5.3 |
| 4,298,910 | 11/1981 | Price | 301/5.7 X |
| 4,363,502 | 12/1982 | Bakerman | 301/5.7 X |
| 4,401,311 | 8/1983 | Almeraz | 301/5.7 X |
| 4,648,610 | 3/1987 | Hegyi | 280/11.19 |
| 5,294,188 | 3/1994 | Vancil, Jr. | 301/5.3 |

*Primary Examiner*—Russell D. Stormer
*Attorney, Agent, or Firm*—Morton J. Rosenberg; David I. Klein

[57] ABSTRACT

A light-generating wheel for an in-line skate includes two side shells and an electric board sandwiched between the two side shells. The electric board has a plurality of light emitters protruding out of one of said two side shells to light on and off, i.e. to flash while the wheel is rotated in skating on the ground.

3 Claims, 3 Drawing Sheets

LIGHT-GENERATING WHEEL FOR AN IN-LINE SKATE

BACKGROUND OF THE INVENTION

This invention concerns a light-generating wheel For an in-line skate, particularly that having a plurality of light emitters to flash while the wheel is rotated during the skate running on the ground in skating.

SUMMARY OF THE INVENTION

The purpose of the present invention is to offer a light-generating wheel to be combined with an in-line skate, which has a plurality of light emitters to flash when it is rotated in skating with the in-line skate provided with this wheel.

The main feature of the present invention is an electric board sandwiched between two side shells forming this wheel. The electric board has a plurality of light emitters fixed around on one of its round surface and protruding out of one of the two side shells, and a battery deposited in battery chamber of the electric board to furnish power for the emitters, and a vibrate switch is used to turn on and off the power of the battery while the wheel is rotated in skating with the in-line skate so that the light emitters may flash on and off by the switch.

BRIEF DESCRIPTION OF DRAWINGS

The invention will be better understood by reference to the accompanying drawings, wherein.

DESCRIPTION OF THE PREFERRED EMBODIMENTS

Figure 1:
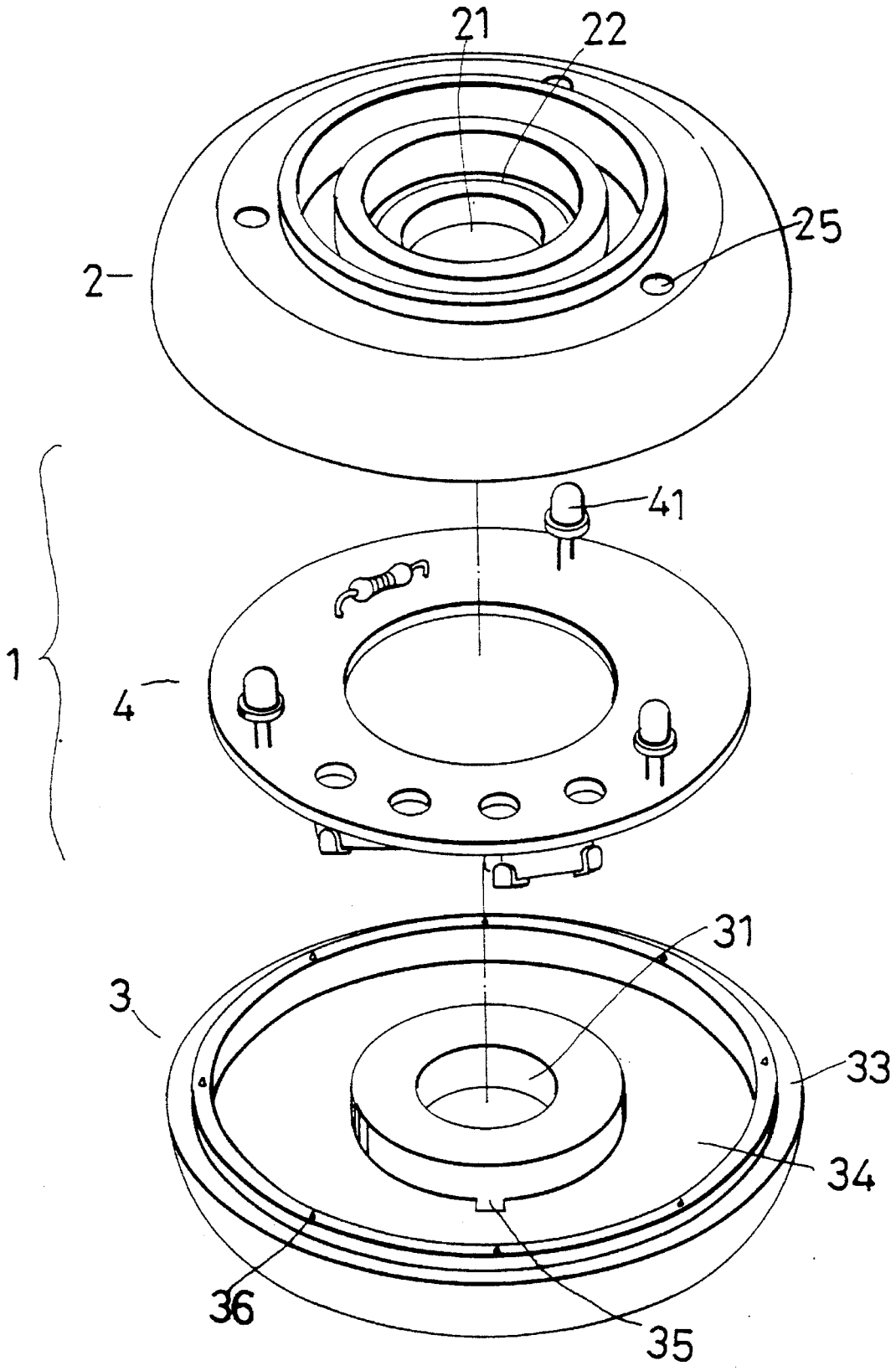
FIG. 1 is an exploded perspective view of a light-generating wheel for an in-line skate in the present invention.
Figure 2:
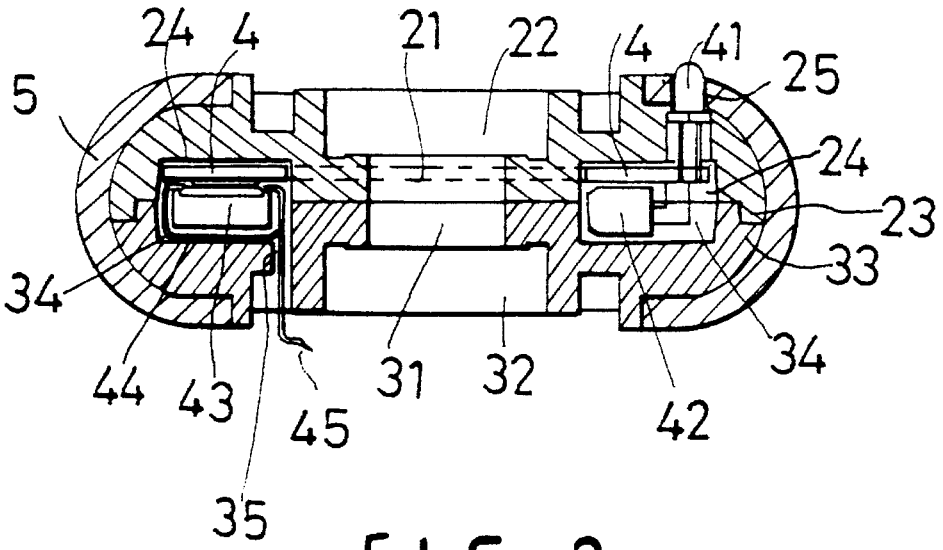
FIG. 2 is a cross-sectional view of a light-generating wheel for an in-line skate in the present invention.

A light-generating wheel 1 for an in-line skate in the present invention, as shown in FIGS. 1 and 2, includes two side shells 2 and 3, and an electric board 3 sandwiched between the two side shells 2 and 3.

The two side—one right and the other left—shells 2 and 3 are of the same shape and a symmetrical structure, respectively having a center hole 21, 31, a larger diameter annular groove 22, 32 than the center hole 21, 31 provided around the center hole 21, 31 for a bearing 6 to fit therein. The right side shell 2 has an inside annular circumferential protruding surface 23, and the eft side shell 3 has an inside annular circumferential recessed surface 33 to fit together with the annular protruding surface 23 of the right side shell 2 so that the two side shells 2 and 3 may be combined firmly together. In addition, the two side shells 2 and 3 respectively have an inside annular hollow space 24, 34 for depositing the electric board 4 therein.

The electric board 4 has a center hole, a plurality of light emitters 41 fixed around on an outer annular portion of the board 4 and protruding out through the holes 25 the right side shell 2, a battery 43 fitted in a battery chamber 44 attached downward on the board 4, and an insulating slip 45 provided to be interposed between the battery 43 and the input terminal of the electric board 4 and to extend out of a through hole 35 in an inside edge of the hollow space 34 of the left side shell 3.

The right side shell 2 especially has a plurality of small holes 25 through the intermediate annular portion for the light emitters 41 to protrude through the outer surface of the shell 2.

In assembling the light-generating wheel 1 for an in-line skate, a plurality of fusible points 36 are attached in advance on the inside annular circumferential surface of the left side shell 3 so that the fusible points 36 are fused to bond together the left side shell 3 with the right side shell 2 by means of a supersonic process after the two side shells 2 and 3 are put together. Then the fused-together two side shells 2, 3 are formed with a layer 5 of PU (polyurethane) foam on the circumference by means of a plastic injecting process for firmly keeping the two shells together.

Figure 3:
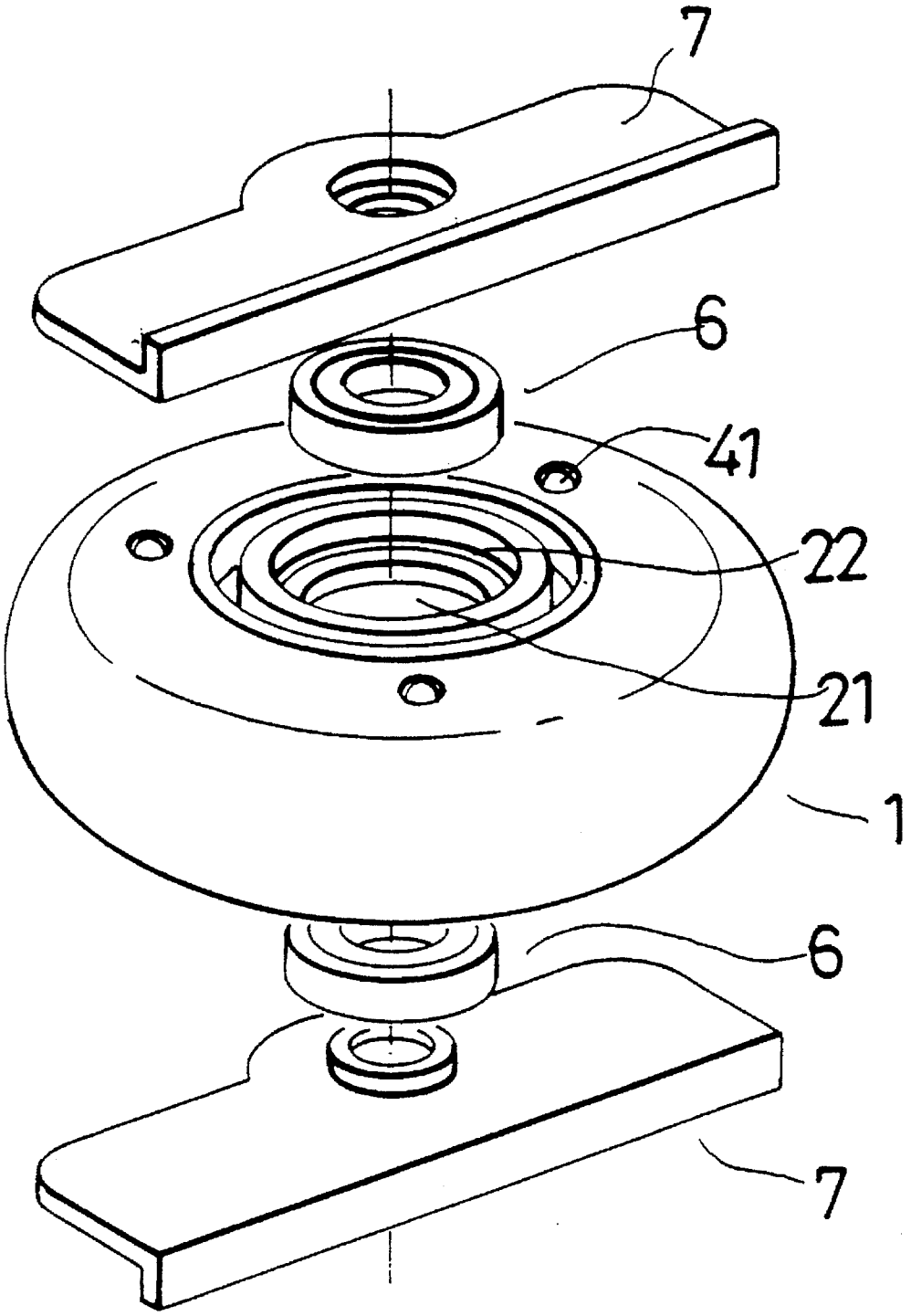
FIG. 3 is a perspective view of positioning plates for fixing the light-generating wheel on an in-line skate in the present invention; and, FIG. 4 is a perspective view of the light-generating wheels fixed on an in-line skate by means of the position plates in the present invention.

Referring to FIG. 3, in assembling the light-generating wheel 1 with the in-line skate, the two bearings 6, 6 are to be firstly fitted in the annular grooves 22, 32 of the two side shells 2 and 3, and two position plates 7, 7 of L-shaped cross-section are provided to be placed diametrically at both sides of the wheel 1. Then, the wheel 1 together with the two position plates 7, 7 is pushed inside an inverted channel-shaped elongate bottom plate 8 of the skate, and then held firmly together with the plate 8 by means of a bolt and nut 81 passing through the elongate plate 8, the position plates 7, 7 and the bearings 6, 6 and the wheel 1. After a plurality of the wheels 1 are assembled in a line with the skate, then the in-line skate with light-generating wheels is finished, ready for use.

Figure 4:
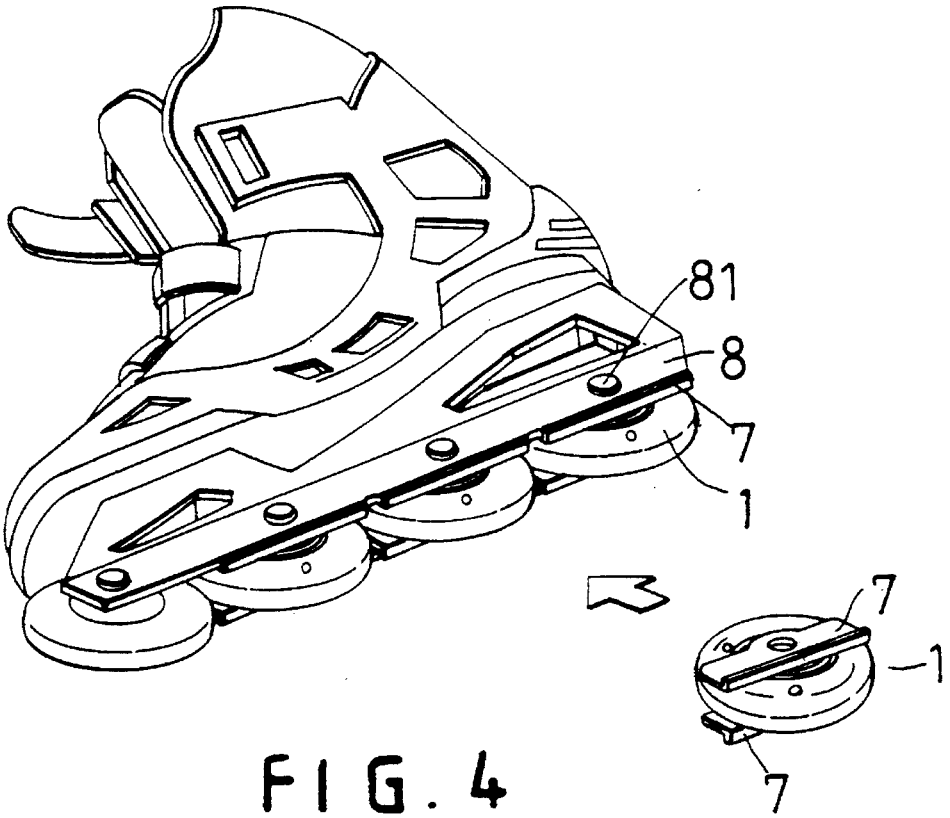

Referring to FIGS. 2 and 4, when the in-line skate with the light-generating wheels is used for skating, the insulating slip 45 has to be pulled out to let the battery 43 and the input terminal of the electric board 4 contact with each other. When the wheels 1 roll on the ground with the skate running, a vibrating switch 42 provided on the electric board 4 turns on and off the power of the battery 43 to let the light emitters 41 to flash on and off. If the wheels 1 are stopped, with the vibrate switch 42 being not vibrated, the circuit of the electric board 4 is cut off, and accordingly the light emitters 41 are not powered To light on and off. Then the power is economized.

From the above description, it may be understood that this light-generating wheel for an in-line skate has the following advantages.

1. It flashes with the vibrate switch vibrated when the skate with it is coasted along on the ground, giving a warning to passers-by for preventing mutual collision, especially during nights.

2. The insulating slip interposted between the battery and the electric board can prevent the battery from consumed until it is used. And the vibrate switch can also turn off the power of the battery if the switch is not vibrated, saving the power of the battery.

3. During skating the light emitters are turned on and off, increasing visual pleasure.

While the preferred embodiments of the invention have been described above, it will be recognized and understood that various modifications may be made therein and the appended claims are intended to cover all such modifications which may fall within the spirit and scope of the invention.

What is claimed is:

1. A light generating wheel for an in-line skate comprising:

a right side shell and a left side shell, each of said side shells having a center hole formed therein and an annular groove formed around said center hole, said annular groove having a diameter larger than a diameter of said center hole, said annular groove being provided for the retention of a bearing therein, said right side shell having a circumferential protruding edge surface formed about a perimeter thereof, said left side shell having a circumferential recessed edge surface formed about a perimeter thereof for mating with said right side shell and forming an interior space therebetween; and an electric board positioned within said interior space and sandwiched firmly between said left and right side shells, said electric board having a plurality of light emitters secured into positions near a circumferential edge of said board, said emitters protruding through respective holes formed in one of said side shells and being turned on and off during skating.

2. The light-generating wheel for an in-line skate as claimed in claim 1, wherein one of said two side shells has a plurality of little fusing points on an internal circumferential surface, said fusing points being fused by means of a supersonic process to bond firmly together said two side shells, said fused-together side shells having a layer of PU foam formed on an external circumferential surface by means of a plastic injecting process.

3. The light-generating wheel for an in-line skate as claimed in claim 1, wherein said electric board has a battery chamber for depositing a battery therein, with an insulating slip being interposed in advance between said battery and the input terminal of said electric board, said insulating slip being removed by the user from said interposing position between said battery and said input terminal to permit the power of said battery to energize the circuit of said electric board.

* * * * *